US005701825A

United States Patent [19]

Peach, Jr.

[11] Patent Number: 5,701,825

[45] Date of Patent: Dec. 30, 1997

[54] GAP CLOSING DEVICE FOR CLOSING SIDE WALL GAPS IN AUTO RACK CARS

[75] Inventor: Walter J. Peach, Jr., Elgin, Ill.

[73] Assignee: Zeftek, Inc., Montgomery, Ill.

[21] Appl. No.: 623,135

[22] Filed: Mar. 28, 1996

[51] Int. Cl.[6] ..... B61D 45/00

[52] U.S. Cl. ..... 105/355; 105/404; 105/424

[58] Field of Search ..... 105/355, 404, 105/409, 378, 424; 52/716.2, 718.01, 718.04, 718.06, 718.03, 717.03

[56] References Cited

U.S. PATENT DOCUMENTS

| | | |
|---|---|---|
| 2,846,959 | 8/1958 | Perry . |
| 3,807,318 | 4/1974 | Chierici . |
| 3,861,110 | 1/1975 | Bartlett . |
| 3,865,358 | 2/1975 | Butters . |
| 4,405,272 | 9/1983 | Wollar . |
| 4,489,465 | 12/1984 | Lemkin . |
| 4,555,885 | 12/1985 | Raymond et al. . |
| 4,913,061 | 4/1990 | Youngblood . |
| 4,945,727 | 8/1990 | Kessler . |
| 4,947,900 | 8/1990 | Destefani et al. . |
| 4,964,347 | 10/1990 | Long et al. . |
| 5,014,934 | 5/1991 | McClaflin . |
| 5,085,545 | 2/1992 | Takahashi . |
| 5,096,753 | 3/1992 | McCue et al. . |
| 5,239,933 | 8/1993 | Murphy et al. . |
| 5,311,823 | 5/1994 | Rudibaugh et al. . |
| 5,415,108 | 5/1995 | Murphy et al. . |
| 5,579,697 | 12/1996 | Burke ..... 105/355 |

OTHER PUBLICATIONS

Thrall Mfg. Co., photograph of gap–sealing device, May 18, 1995 (1 page).

*Primary Examiner*—Mark T. Le
*Attorney, Agent, or Firm*—Lloyd L. Zickert

[57] ABSTRACT

A device for closing the gap between adjacent sidewall panels in an auto rack railroad car in the form of a generally H-shaped elongated plastic member grippingly engaging the panels and closing the gap to prevent the movement of air and precipitation through the gap. The device may be made as a one-piece or two-piece unit.

26 Claims, 3 Drawing Sheets

18
16
28
30
2
32
28
10
34
12
14
22
2
26
22

16
40
31
30
28
28
30
31
60
46
60
30
30
10
38
44
30
30
36
30
30
42
12

GAP CLOSING DEVICE FOR CLOSING SIDE WALL GAPS IN AUTO RACK CARS

This invention relates in general to a gap closing device for closing air gaps in auto rack railroad cars to protect the vehicles being transported from being damaged by air-carried contaminants, and more particularly to a gap closing device for closing and sealing the air gaps between vertically adjacent sidewall panels to prevent water or moisture from entering the auto rack cars through the gaps.

BACKGROUND OF THE INVENTION

Heretofore, it has been common practice to transport newly manufactured vehicles, such as automobiles, vans, and trucks, made in this country or imported into this country on auto rack equipped railroad cars. The transportation of newly manufactured vehicles by railroad is usually over long distances above three hundred miles. For example, domestic vehicles manufactured in the Midwest are usually transported to the West Coast by rail, or in another example, imported vehicles manufactured abroad which arrive on the West Coast are usually transported to midwestern cities by rail. A train having auto rack equipped railroad cars, known in the industry as auto rack cars, can take several days to reach its destination while traveling over thousands of miles through varying terrain. These trains also travel throughout the year enduring the severest of winter and summer weather as well as other environmental and man-made conditions.

The typical auto rack car is compartmented, having two or more decks, opposed side walls, doors in front and back or at each end, and a roof. The side walls are usually constructed of a plurality of horizontally extending and vertically spaced apart sidewall panels or screens made of corrugated galvanized steel. The vertical rows of panels are mounted between vertical posts that are spaced throughout the length of a car. The side walls have horizontally extending air gaps or openings defined between adjacent vertically spaced apart sidewall panels.

These gaps are of such a size as to permit the entry of rapidly moving air into the auto rack car and thus onto the newly manufactured vehicles being stored in transit. The air entering the auto rack car may carry contaminants such as iron oxide, smoke or exhaust from the railroad engine, metal filings or shavings from the railroad tracks, dirt or sand carrying chemicals such as fertilizer, acid rain, and other precipitation-containing contaminants, all of which can damage the finishes of the newly manufactured vehicles. This damage can be so extensive that the manufacturer has to repaint or refinish the vehicles. To solve this problem, the auto industry has sometimes placed protective plastic sheets or wrappings on all or part of the vehicles prior to shipment.

Devices for closing the gaps on the auto rack cars have also been developed such as those disclosed in U.S. Pat. Nos. 5,239,933, 5,311,823, and 5,415,108. It has been found that these devices do not completely solve the problem of water or moisture entering the auto rack car through the gaps. The water or moisture that enters the car tends to invade the car and can cause damage in the car. Where chocks are used to secure the vehicles in transit, the chocks, when not in use, are hung on the inside surface of the sidewall panels or placed in chock boxes adjacent the side walls. Water entering the car through sidewall gaps may damage the chocks. For instance, in freezing temperatures, the water collecting on and around the chocks freezes thereby inhibiting the use of the chocks, and in some cases damages the chocks such that they cannot be used. Similarly, chain tie-down devices or other devices stored inside the car adjacent the side walls may be subjected to damage by water entering the gaps. Accordingly, there is a need for a gap closing device which provides a substantially water-tight seal at the sidewall gaps to prevent water or moisture from entering the cars, as well as preventing air from entering the car through the gaps.

SUMMARY OF THE INVENTION

The present invention overcomes the above problems in providing a gap closing device for closing the gaps between adjacent sidewall panels of an auto rack car which provides a substantially water-tight seal to prevent air and water or moisture from entering the cars through the gaps and causing damage to vehicles and/or interior components of the car. The gap closing device of the present invention may be constructed as a single piece or in two pieces. Both the single-part and the two-part gap closing devices can be installed on the sidewall panels when the car is originally constructed or when the car is being refurbished or renovated as the panels are mounted. Additionally, the two-part gap closing device can be placed in the existing gap between adjacent panels on auto rack cars.

The single-part gap closing device of the present invention is the preferred embodiment and includes an elongated piece or strip of H-shaped extruded plastic, such as a low density polyethylene or other suitable material. This embodiment includes a box-shaped body having spaced-apart interior and exterior walls interconnected by spaced apart top and bottom walls for substantially filling the gap and providing structural rigidity. Lower interior and exterior attaching arms extending from the body attach the gap closing device to the lower sidewall panel and upper interior and exterior attaching arms extend from the body for slidably engaging the upper sidewall panel. The upper and lower interior arms include locking lips for locking onto the flanges of the upper and lower sidewall panels. The upper and lower exterior arms engage the faces of the adjacent sidewall panels and create a substantially water-tight seal therewith. The gap closing device may also be constructed with one or both of the upper and lower exterior arms having gripping lips for engaging the exterior of the upper and/or lower sidewall panels which enhance the substantially water-tight seal between the upper and lower arms and the upper and lower sidewall panels. The upper arms are longer than the lower arms to facilitate sliding engagement with the sidewall panels and accommodate gaps of varying sizes.

The gap closing device of the present invention may include a bumper or flap extending from the interior side of the gap closing device into the car for preventing vehicle doors from contacting the sidewalls and thereby damaging the doors. The gap closing device of the present invention may also include a rain diverter extending from the exterior side of the gap closing device outside of the car for channeling and directing the rain or water flowing down the side wall toward the vertical posts where the water drains without entering the car.

A further embodiment of the gap closing device of the present invention includes upper and lower attaching arms respectively connected to a body wherein the top or bottom wall of the body consists of opposing locking bars which are extruded in open position and interlocked prior to installation. This alternative gap closing device simplifies the extrusion process because it eliminates the need to extrude the box-shaped body.

A still further embodiment of the present invention includes a two-part gap closing device having coacting female and male members. The female member has upper and lower attaching arms respectively connected to a C-shaped body which is adapted to receive the male member. The body of the female section includes spaced-apart parallel top and bottom walls connected at one end by an exterior wall which forms a socket for receiving the male member. The male member has spaced apart parallel top and bottom locking bars connected at one end by an interior wall. The female member is mounted in the horizontal gap between the adjacent panels and the male member is inserted into the socket of the female member to lock the two-part gap closing device in the gap and on the adjacent panels. The male member may extend the entire length of the female member or may be made in suitably sized sections.

It is therefore an object of the present invention to provide an improved, somewhat H-shaped gap closing device for closing the horizontally extending gaps between adjacent sidewall panels on an auto rack car which prevents air-carried contaminants from entering the car and damaging the finishes of newly manufactured vehicles being transported in auto rack cars.

Another object of the present invention is to provide a gap closing device for closing the horizontally extending gaps between adjacent sidewall panels on an auto rack car which provides a substantially water-tight seal to prevent water or moisture from entering the car through the gaps.

Another object of the present invention is to provide a single-piece gap closing device for closing the horizontally extending gaps between adjacent sidewall panels on an auto rack car and which can be installed during construction or renovation of the cars.

Another object of the present invention is to provide a two-piece gap closing device for closing the horizontally extending gaps between adjacent sidewall panels on an auto rack car and which can be installed on existing cars or during construction or renovation of the cars.

Another object of the present invention is to provide a gap closing device for closing the gaps between adjacent sidewall panels on an auto rack car which further includes a bumper for preventing the vehicle doors from contacting the side wall and damaging the vehicle doors.

Another object of the present invention is to provide a gap closing device for closing the gaps between adjacent sidewall panels on an auto rack car which further includes a rain diverter for catching, channeling, and directing water away from the side walls.

A still further object of the present invention is to provide a gap closing device for closing the gaps between adjacent sidewall panels on an auto rack car which eliminates the need for anti-theft bars between adjacent sidewall panels.

Other objects, features and advantages of the invention will be apparent from the following detailed disclosure, taken in conjunction with the accompanying sheets of drawings, wherein like reference numerals refer to like parts.

DESCRIPTION OF THE INVENTION

The gap closing device of the present invention provides a substantially water-tight and air-tight seal between vertically adjacent sidewall panels to prevent the entry of water or moisture and air into the auto rack car through the horizontally extending gaps between those panels to reduce damage to vehicles and the interior of the car.

Figure 1:
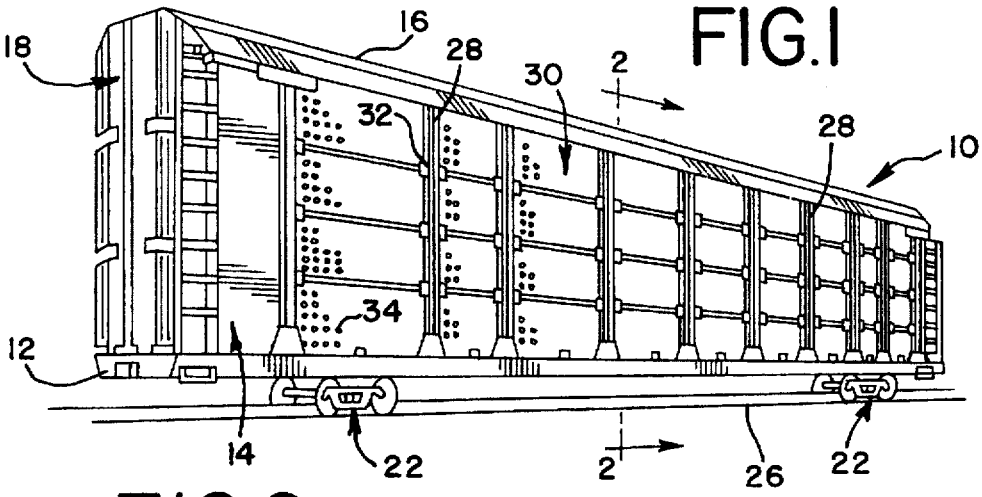
FIG. 1 is a perspective view of a typical auto rack car having a series of vertical posts on each side wall and four sidewall panels horizontally extending and vertically mounted between the vertical posts and including the gap closing device of the present invention.
Figure 2:
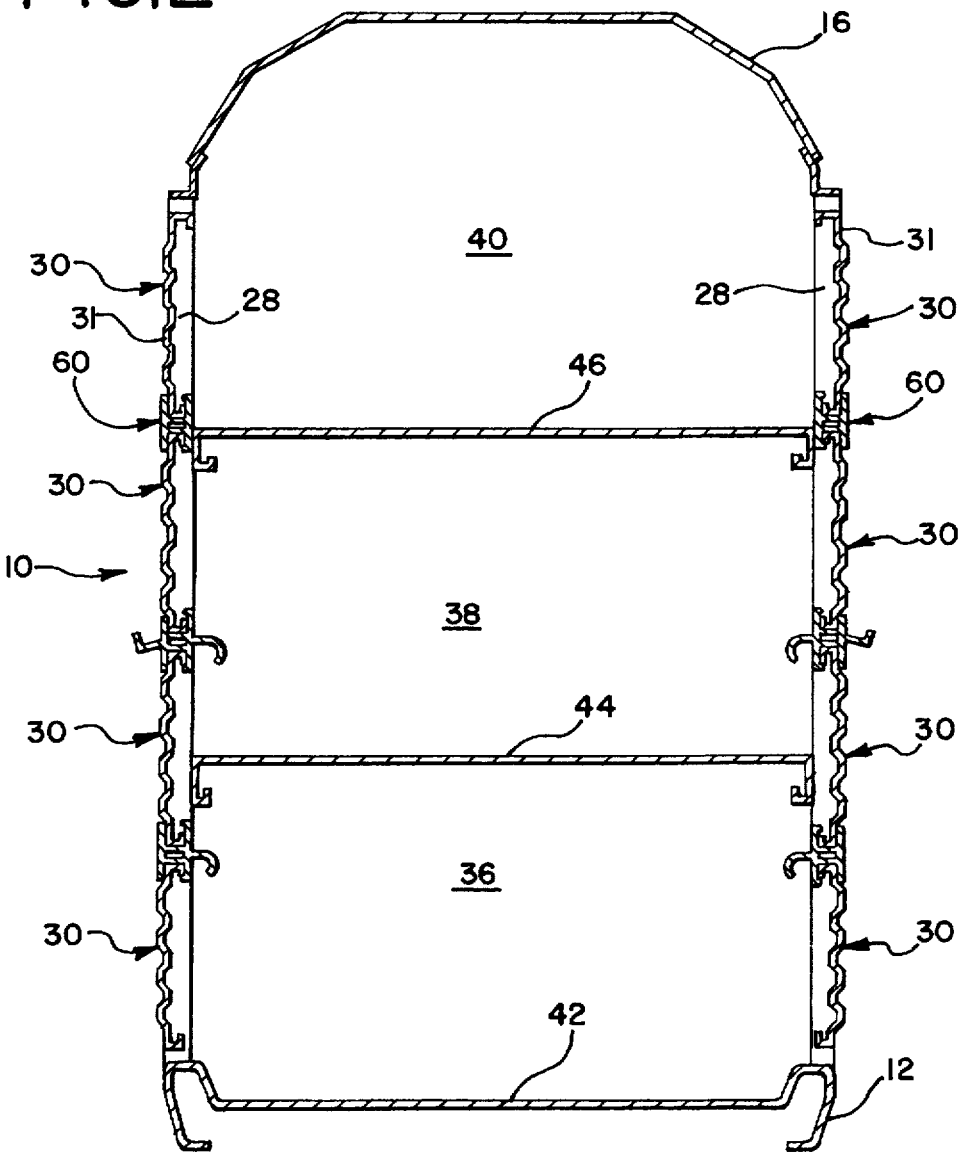
FIG. 2 is a cross-sectional view of the tri-level auto rack car taken substantially along line 2—2 in FIG. 1 and generally illustrating the placement of the gap closing device of the present invention in the horizontal gaps.
Figure 3:
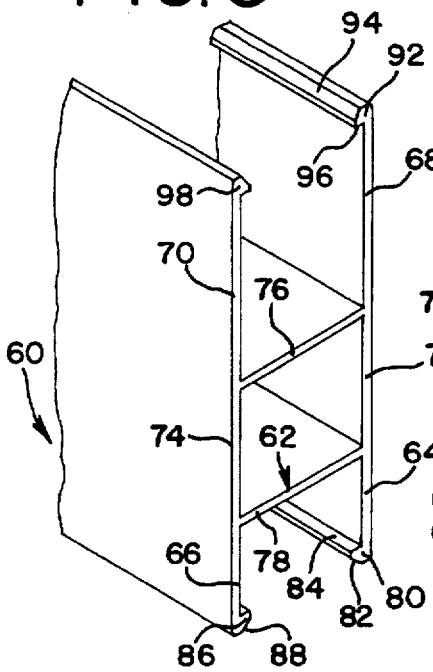
FIG. 3 is a fragmentary perspective view of the single-piece gap closing device of the present invention illustrating the box-shape body and the upper and lower arms extending from the body.
Figure 4:
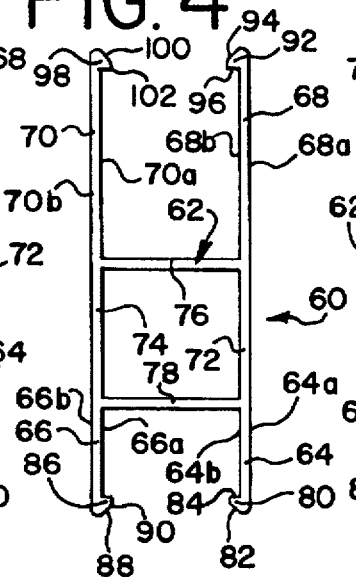
FIG. 4 is an end view of the embodiment of FIG. 3.

Referring now to the drawings, and particularly to FIGS. 1 to 2, a typical auto rack car 10 includes a frame 12 which supports two side walls 14 and a roof 16. At each end of the auto rack car 10 are two pairs of doors 18 that are opened during the loading and unloading of vehicles. The frame 12 is supported on a pair of trucks 22, each of which has several wheels 24 that roll along railroad tracks 26.

The side walls 14 include a series of steel vertical posts 28 which are mounted on and extend upwardly from the frame 12 to the roof 16 which is supported by these vertical posts. The vertical posts 28 are spaced along the entire length of both sides walls 14 of the auto rack car. A plurality of rectangular galvanized steel sidewall panels or screens 30 having a corrugated body 31 extend horizontally and are vertically spaced apart between each pair of vertical posts 28. These sidewall panels 30 are supported at their corners by metal brackets 32 that are suitably secured to the vertical posts 28. Each sidewall panel 30 has a multiplicity of round sidewall panel holes 34 that are approximately five-eights of an inch (16 mm) in diameter and provide the auto rack car with light as well as ventilation.

The auto rack car 10 illustrated in FIG. 2 is a tri-level car having first, second, and third compartment levels 36, 38, and 40, respectively. The first level 36 includes a floor or deck 42 and the second and third levels 38 and 40 include decks 44 and 46, respectively, on which the vehicles are supported. Normally, eighteen passenger vehicles can be transported in a tri-level auto rack car, six on each level. Auto rack cars are also manufactured as bi-level cars which differ from the tri-level car in that they include only two levels for vehicles. The bi-level car is generally used to transport larger vehicles such as vans, mini-vans, pick-up trucks, and sport utility vehicles or four-by-fours. Further, the bi-level cars can usually transport twelve of these vehicles, six on each level.

In both the tri-level and bi-level cars, the sidewall horizontally extending gaps are defined between vertically adjacent edges of the sidewall panels 30. Each sidewall panel 30 of the auto rack car has an L-shape flange 50 extending around its periphery, as further illustrated in FIG. 5. The L-shaped flange 50 has a first leg 52 which is connected to the corrugated body or face 31 of the sidewall panel 30 and which extends generally horizontally into the car and substantially perpendicular to the face 31. The flange has a second leg 54 which is connected to the first leg 52 and is substantially parallel to the face 31 of the panel 30. The horizontal sidewall panel gap extends between the first legs of the flanges of adjacent sidewall panels. The height of these sidewall panel gaps 48 generally vary from about one and three-eights inches to two and one-half inches (35 to 64 mm).

Auto rack cars are constructed with these gaps for several reasons. The sidewall panels and the vertical posts are galvanized steel and tend to expand as the temperature increases and contract as the temperature decreases. The construction of the sidewall panels allows for this thermal expansion and contraction. The auto rack car is also constantly shimmying, swaying, twisting, and rocking when in transit. The construction of the vertical posts and the attachment of the sidewall panels allow for this minor movement without structural damage to the entire car. Furthermore, manufacturing and construction tolerances result in the varying size gaps.

Referring now to FIGS. 2 to 5, the gap closing device of the present invention, generally indicated by numeral 60, is a somewhat H-shaped in cross section elongated piece or strip of an extruded plastic having an elongated box-shaped body 62, lower interior and exterior attaching arms 64 and 66 extending downwardly from the body 62, and upper interior and exterior arms 68 and 70 extending upwardly from the body 62. More particularly, the gap closing device 60 is constructed from an extrudable grade low-density polyethylene plastic of approximately a sixty D (60 D) durometer hardness rating, although other suitable extrudable plastics may be used for the device. The plastic preferably includes an ultraviolet (UV) inhibitor incorporated in a gray color containing approximately one-tenth of one percent of a hindered amine light stabilizer. The UV inhibitor prevents deterioration from ultraviolet rays. It should be appreciated that other suitable extrudable plastic materials of any suitable color, such as rubber or urethane, may be used in constructing the gap closing device and that other UV inhibitors could be used.

Figure 5:
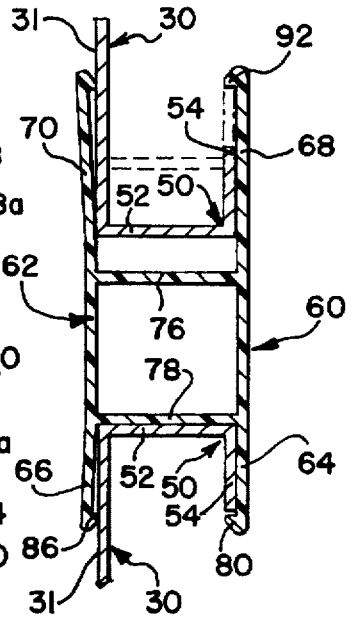
FIG. 5 is a cross-sectional view of the gap closing device mounted in a horizontally extending gap between adjacent upper and lower sidewall panels, and illustrating in phantom the varying height of the horizontal gap that may be encountered.

The cross-sectional box-shaped body 62 of the gap closing device 60 includes parallel spaced apart interior and exterior walls 72 and 74 integrally connected by parallel spaced apart top and bottom walls 76 and 78. The body 62 is substantially square in shape and provides structural rigidity to the gap closing device 60, although other shapes may be suitable. The body 62 is positioned in the gap between the first legs 52 of the flanges 50 of the upper and lower adjacent sidewall panels to substantially fill the horizontally extending gap, as shown in FIG. 5. The bottom wall 78 of the body normally rests on or engages the first leg 52 on the lower sidewall panel flange and the top wall 76 may or may not engage the first leg 52 of the upper sidewall panel flange depending on the height of the gap. The width of the body is slightly greater than the width of the sidewall panel and its flange.

The lower interior and exterior attaching arms 64 and 66 are spaced apart, parallel, and somewhat flexible members which are integrally connected to the body 62 and specifically to the interior and exterior walls 72 and 74, respectively. These arms connect the gap closing device 60 to the lower sidewall panel and coact with the body to close and seal the sidewall panel gap 48. The space between the arms 64 and 66 is only slightly greater than the width of sidewall panel and the first leg 52 of its flange, thereby providing a snug fit between the attaching arms and the sidewall panel. To install the gap closing device, the lower attaching arms 64 and 66 are mounted over the face 31 and flange 50 of the lower sidewall panel causing the ends of the arms opposite the body to flex apart.

More particularly, the lower interior attaching arm 64, which has inside and outside surfaces **64*a* and 64*b*, includes a locking lip 80 on its outside surface 64*b* at the end of the arm opposite the body. The locking lip 80 has a chamfered or beveled edge 82 which engages the flange 50 which causes the arm 64 to flex into the car when the gap closing device 60 is being mounted on the lower sidewall panel. The arm 64 is preferably longer than the second leg 54 of the flange 50 and snaps back to its extruded or natural position after the locking lip 80 passes the bottom edge of the second leg of the flange, as illustrated in FIG. 5. The locking lip 80 also has a stopping shoulder 84 which is adapted to engage the bottom edge of the second leg 54** to prevent the arm from being dislodged from the flange of the sidewall panel.

The lower exterior attaching arm 66, which has inside and outside surfaces **66*a* and 66*b*, has a gripping lip 86 on its inside surface 66*a* at the end of the arm opposite the body. The gripping lip 86 has a chamfered or beveled edge 88 which engages the face 31 of the lower sidewall and which causes the arm 66 to flex outwardly when the gap closing device is being mounted on the lower sidewall panel. The arm remains flexed when the gap closing device is fully mounted as seen in FIG. 5. The gripping lip 86 also has a sealing edge 90 which engages the face 31 of the lower sidewall panel 30 which supplements the substantially water-tight seal created between the exterior arm 66 and the lower sidewall panel 30 to prevent water from entering the car through the gap. The gripping lip 86 enhances the pressure seal against the face 31 because the arm is flexed or mounted against the memory of the extruded plastic material. This gripping lip 86 and the exterior attaching arm 66 also function to grippingly engage the face of the sidewall panel and coact with the interior attaching arm 64** to maintain the gap closing device on the lower sidewall panel. It should be appreciated that the gripping lip may have multiple sealing edges which engage the face of the sidewall panel.

The upper interior and exterior attaching arms 68 and 70 are spaced apart parallel members which are integrally connected to the body 62 and specifically to the interior and exterior walls 72 and 74, respectively. These arms attach the gap closing device 60 to the upper sidewall panel and coact with the body to close and seal the sidewall panel gap. The space between the arms 68 and 70 is slightly greater than the width of the sidewall panel and its flange. After the gap closing device is installed on the lower sidewall panel, the upper sidewall panel is mounted on the car by inserting the panel into the brackets 32 and between the upper attaching arms 68 and 70. As the panel is inserted in between the upper attaching arms, the arms are pushed or flexed apart. It should thus be appreciated that the gap closing device 60 is installed during initial construction of the car or during refurbishing of the car.

The upper interior attaching arm 68 which has inside and outside surfaces **68*a* and 68*b*, includes a locking lip 92 on its outside surface 68*b* at the end of the arm opposite the body. The locking lip 92 has a chamfered or beveled edge 94 which engages the flange 50 of the sidewall panel as the device is being mounted on the panel. The arm 68 is longer than the second leg 54 of the flange and snaps back to its extruded or natural position after the locking lip 92 passes the top edge of the second leg of the flange as seen in FIG. 5. The locking lip 92 also includes a stopping shoulder 96** which is adapted to engage the top edge of the second leg to prevent the arm from being dislodged from the flange of the upper sidewall panel.

The upper exterior attaching arm 70, which has inside and outside surfaces **70*a* and 70*b*, has a gripping lip 98 on its inside surface 70*a* at the end of the arm opposite the body. The gripping lip 98 has a chamfered or beveled edge 100 which engages the face 31 of the upper sidewall panel and causes the arm 70 to flex outwardly when the gap closing device is mounted on the upper sidewall panel. The arm 70 remains flexed when the gap closing device is fully mounted. The gripping lip 98 also has a sealing edge 102 which engages the face 31 of the upper sidewall panel 30 to supplement the substantially water-tight seal created between the exterior arm 70 and the face 31 of the upper sidewall panel 30 to prevent water flowing or running down the panel from entering between the arm and the panel and thus entering the car through the gap. Any water that flows down the sidewall panel is directed to continue down the panel and to the ground. The gripping lip 98 enhances the pressure seal against the face 31 since the arm is flexed or mounted against the memory of the extruded plastic material and thus supplements the substantially water-tight seal formed between the exterior arm 70 and the face 31 of the sidewall panel 30. This gripping lip 98 and the arm 70 also function to grippingly engage the face of the sidewall panel and coact with the upper interior arm 68 to maintain the gap closing device on the upper sidewall panel. It should be appreciated that the gripping lip 98** may have multiple sealing edges which engage the face of the sidewall panel.

The upper arms 68 and 70 are significantly longer than the lower arms 64 and 66 to compensate for gaps of varying sizes. As explained above, the horizontal gaps between adjacent sidewall panels range from one and three-eights inches to two and a half inches. The upper arms must therefore be long enough to span the gap at its greatest height as shown in phantom in FIG. 5.

The gap closing device 60 of the present invention also eliminates the need for anti-theft bars. The gap closing device is substantially rigid when mounted on the adjacent sidewall panels and it is extremely difficult to pull the gap closing device off the panels by hand. A pry bar or other tool would be necessary to remove the gap closing device mounted on adjacent sidewall panels, thereby substantially decreasing the chance of vandalism.

Figure 6:
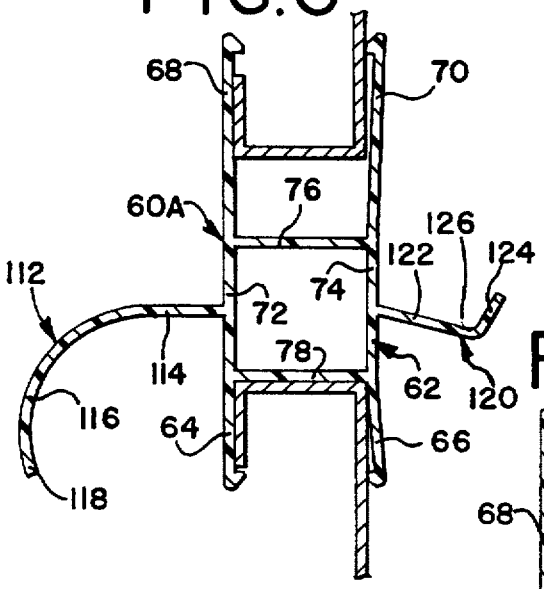
FIG. 6 is a cross-sectional view of a further embodiment of the gap closing device of the present invention mounted between adjacent sidewall panels and having a bumper extending into the car from the interior side of the gap closing device, and a rain diverter extending outward of the car from the exterior side of the gap closing device.

A further embodiment of the invention is illustrated in FIG. 6, wherein the gap closing device, generally indicated by numeral 60A, includes a longitudinally extending vehicle door bumper 112 on the inside and a longitudinally extending rain diverter 120 on the outside. The bumper 112 is extruded from the same material as the gap closing device 60A and is integrally attached to the interior wall 72 of the body 62 approximately mid-way between the top and bottom walls 76 and 78 thereof. The bumper 112 has a substantially straight section 114 extending from the body at a substantially perpendicular angle and a generally arcuately shaped second section 116 connected to the first second. The second section may have a tapered free end 118. When a vehicle door is opened, it will contact the bumper 112 instead of the sidewall panels and the bumper will absorb any impact from the vehicle door, thereby preventing damage or harm to the finish of that door. It should be appreciated that the bumper may be attached to the interior side of the gap closing device 60A at a different position intermediate the ends of the lower and upper interior arms 64 and 68 of the gap closing device.

The gap closing device 60A also includes a rain diverter 120 which is extruded from the same material as the gap closing device 60A and is integrally attached to the exterior wall 74 of the body 62 approximately mid-way between the top and bottom walls 76 and 78 thereof. The rain diverter 120 includes a first substantially straight section 122 extending outwardly and downwardly from the body 62 and a second substantially straight section 124 integrally connected to the first section and extending upwardly. The second section 122 is connected to the first section at a substantially perpendicular angle and extends upwardly outside of the car to form a channel 126 for catching the water in the rain diverter 120. The rain diverter 120 catches the water flowing down the sidewall panel and directs or channels the water to the ends of the gap closing device at the vertical posts. The water flows harmlessly down the vertical posts to the ground instead of entering the car. It should be appreciated that the rain diverter may be attached to the exterior side of the gap closing device 60A at any desired position intermediate the ends of the lower and upper interior arms 66 and 70.

Figure 7:
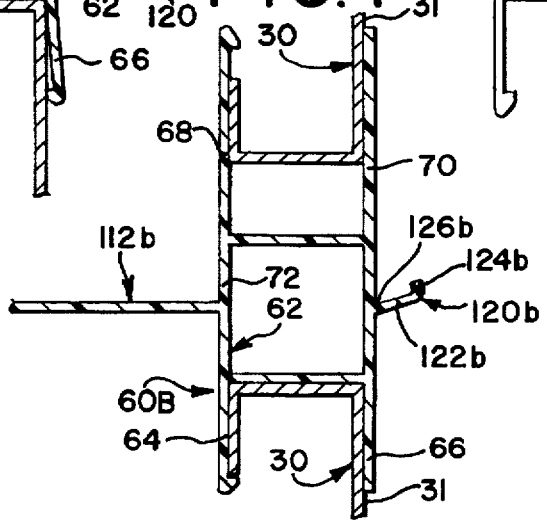
FIG. 7 is a cross-sectional view of a further embodiment of the gap closing device of the present invention which does not include gripping lips on the exterior arm and which includes a substantially straight bumper extending into the car and an alternatively shaped rain diverter extending outside of the car.

Referring now to FIG. 7, a further embodiment of the gap closing device, generally indicated by the numeral 60B, is illustrated. The gap closing device 60B differs from the device 60 of FIGS. 3 to 5 in that the upper and lower exterior attaching arms 66 and 70 do not include gripping lips. The entire inner surface of each exterior arm is essentially flush with the face 31 of the sidewall panel 30 and provides a substantially water-tight seal between the gap closing device and the panel. It should thus be appreciated that any embodiment of the gap closing device of the present invention could be constructed without one or both of the gripping lips on either the interior or the exterior arms.

The device 60B also includes an alternatively shaped bumper **112*b* and an alternatively shaped rain diverter 120*b*. The bumper 112*b* constitutes a straight section that extends perpendicularly from the interior wall 72 of the body 62 straight into the car. When a vehicle door is opened, it will contact the edge of bumper 112*b* instead of the sidewall panels and the bumper will absorb any impact from the vehicle door, thereby preventing damage or harm to the finish of that door. This straight bumper may be coextruded with the gap closing device from a more flexible material, if desired, as can the bumper 112. The rain diverter 120*b* has a first substantially straight section 122b integrally connected to the exterior wall 74 of the body and extending outwardly and upwardly from the gap closing device. A second substantially straight section 124b is connected to the first section 122b and extends upwardly substantially parallel to the car. The rain diverter forms a channel 126b with the exterior side of the gap closing device for catching the water flowing down the sidewall panel and directing or channeling the water to the ends of the gap closing device adjacent the vertical posts. It should be appreciated that the gap closing device of the present invention could be formed only with a bumper or only with a rain diverter, or with both as illustrated in FIGS. 6 and 7**.

Figure 8:
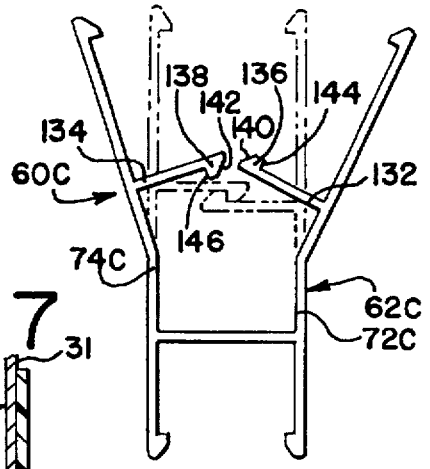
FIG. 8 is a cross-sectional view of a further embodiment of the gap closing device of the present invention.

A further embodiment of the gap closing device of the present invention, generally indicated by numeral 60C, is illustrated in FIG. 8. The gap closing device 60C eliminates the box-shaped body for extrusion purposes by replacing the top wall of the body with coacting locking bars 132 and 134 attached to the interior and exterior walls of the gap closing device. More specifically, the locking bar 132 is integrally attached to the interior wall 72c of the body 62c and the locking bar 134 is integrally attached to the exterior wall 74c of the body 62c. The gap closing device 60C is extruded with locking bars 132 and 134 in open or unlocked position and with a crease in the interior and exterior walls to facilitate bending. The locking bars 132 and 134 respectively include locking tabs 136 and 138 at the ends of the bars opposite the interior and exterior walls. The locking tabs have coacting and opposing chamfered or beveled edges 140 and 142. The locking bars also have locking shoulders 144 and 146 which coact to interlock the locking bars, as shown in phantom in FIG. 8. The locking bars are locked together prior to installation by bending the interior and exterior walls toward each other at the creases. The locking bars may include any suitable coacting latching arrangement, and the gap closing device 130 may additionally include a bumper or a rain diverter or both.

Figure 9:
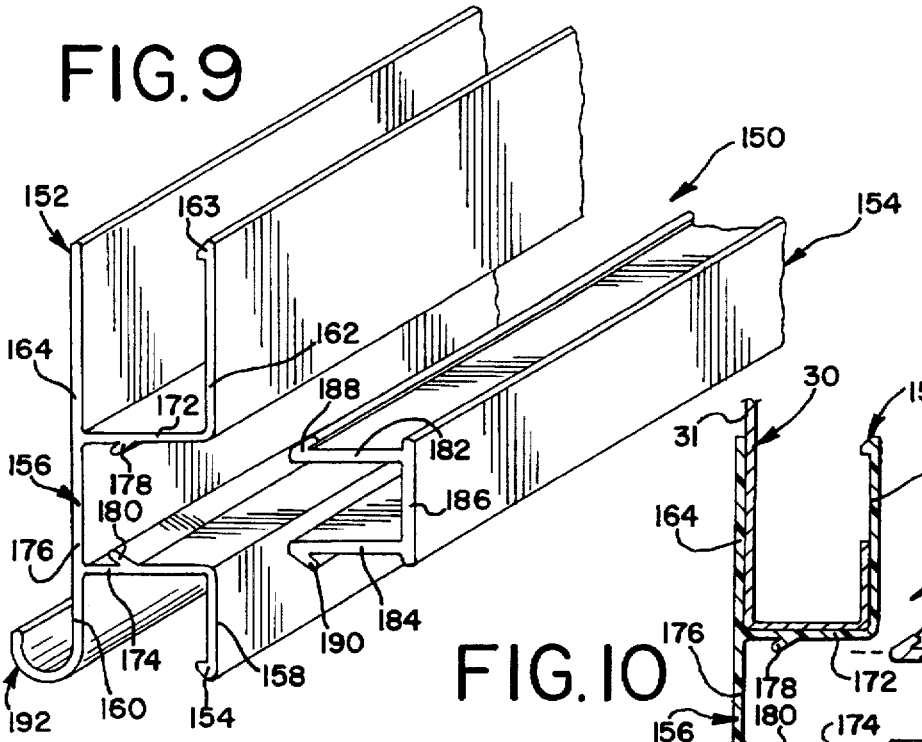
FIG. 9 is a fragmentary exploded perspective view of the two-piece gap closing device of the present invention illustrating the coacting male and female members.
Figure 10:
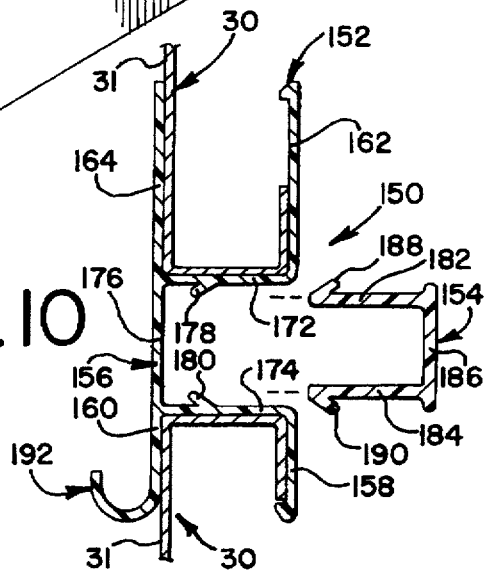
FIG. 10 is an exploded cross-sectional view of the embodiment of FIG. 9 and illustrating the placement of the female member of the gap closing device in the horizontal gap.
Figure 11:
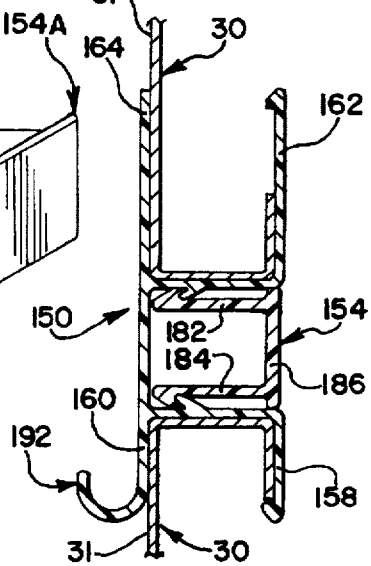
FIG. 11 is a cross-sectional view of the two-piece gap closing device mounted in a horizontal gap between adjacent upper and lower sidewall panels.

Referring now to FIGS. 9 to 11, a further embodiment of the gap closing device of the present invention, generally indicated by the numeral 150, is illustrated. The two-piece gap closing device 150 includes coacting female and male members 152 and 154, respectively. The female member is preferably constructed from an extrudable grade low-density polyethylene like the gap closing member of FIG. 3, although other suitable materials may be used. The male member is preferably constructed from an extrudable grade rigid polyvinyl chloride (PVC), although other suitable materials may be used.

The female member 152 has an elongated body 156 that includes downwardly extending lower interior and exterior attaching arms 158 and 160, for engaging the lower sidewall panel 30, upper interior and exterior arms 162 and 164 extending upwardly from the body for slidably engaging the upper sidewall panel 30, and an interconnecting wall 176 at the exterior and aligned with arms 160 and 164. The lower and upper interior arms 158 and 162 include locking lips 159 and 163, respectively, for locking the arms on the flanges of the sidewall panels. The lower and upper exterior arms 160 and 164 lie flush against the outer sides of the sidewall panels and create a substantially water-tight seal with the faces 31 of the panels. Preferably, the exterior arms are formed without the gripping lips shown in the embodiment of FIGS. 3 to 6. The body 156 of the female member 152 forms a generally C-shaped socket and includes horizontally extending parallel spaced apart top and bottom walls 172 and 174 integrally connected to the inter-connecting wall 176. The top and bottom walls 172 and 174 include opposing locking lips or tabs 178 and 180 which are adapted to coact with the male member 154 to secure the male and female members together and lock the gap closing device in place to the panels.

The male member 154 is a generally C-shaped elongated strip of extruded plastic having spaced apart parallel top and bottom locking bars 182 and 184 interconnected by an integrally formed connecting interior wall 186. The height of the top and bottom locking bars 182 and 184 is slightly less than the distance between the top and bottom walls 172 and 174 of the female member such that the locking bars fit between those walls. The top and bottom locking bars include locking tabs 188 and 190 for coacting with the locking lips 178 and 180 on the top and bottom walls 172 and 174 of the female member to lock the male member in place when inserted into the female member, as illustrated in FIG. 11. More particularly, to install the gap closing device 150 on the sidewall panels, the upper and lower interior arms 158 and 162 of the female member 152 are flexed or bent toward each other and inserted into the gap from the outside of the car. After being fully inserted through the gap, the interior arms flex back to their natural position into engagement with the flanges of the sidewall panels. The male member 154 is then inserted into the socket of the female member. Since the male member is formed from a substantially more rigid material than the female member, the locking lips 178 and 180 on the female member give way as the locking tabs 188 and 190 on the male member move over the lips. The tabs then engage the lips to lock the male member in place and maintain the upper and lower arms in engagement with the upper and lower sidewall panels. As also seen in FIG. 11, when the male and female members are mated, the outer surface of the interior wall 186 of the male member is substantially flush with the outer surfaces of the lower and upper interior attaching arms 158 and 162 of the female member to add structural rigidity to the female member. The male member and the top, bottom, and exterior walls of the female member coact to provide a substantially rigid body for the gap closing device 150.

A U-shaped rain diverter 192 is integrally formed at the lower end of the lower exterior arm 160 of the gap closing device 150. The rain diverter catches the water and channels or directs it to the vertical posts where it drains harmlessly without entering the car. Alternatively, the rain diverter may be attached anywhere along the exterior wall of the gap closing device. Although not shown, a bumper member may be integrally formed on the interior wall of the male member or on the interior upper or lower attaching arms of the female member. When a bumper member is formed on the male member, it will be appreciated that male members with and without bumpers may be inventoried and substantially reduce the inventory of parts as the female member may be used with either male member.

Figure 12:
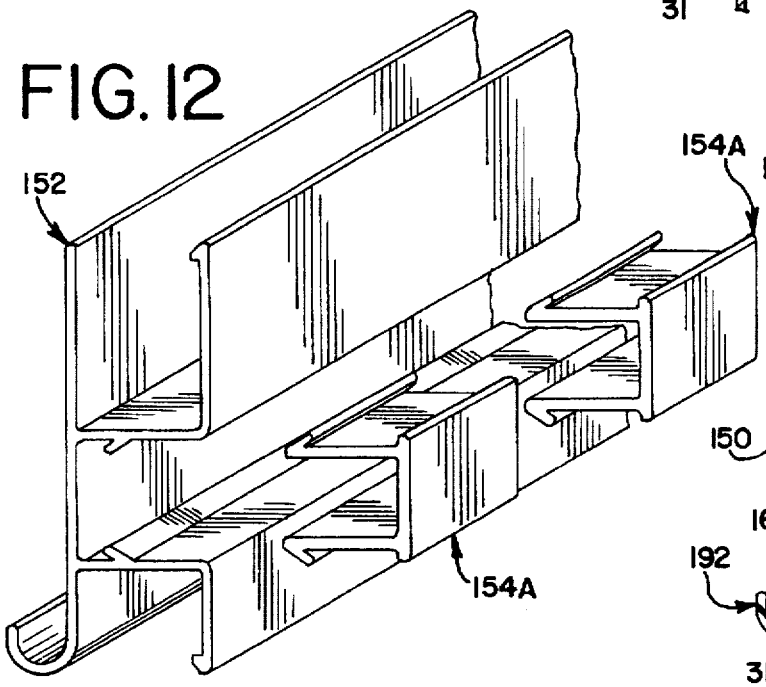
FIG. 12 is a fragmentary perspective view of a further embodiment of the two-piece gap closing device of FIG. 9 in which a plurality of spaced apart male members are mated with a single female member.

Referring now to FIG. 12, the two-piece gap closing device 150 is shown where a plurality of shorter male members 154A are employed to lock the device on the sidewall panels rather than a continuous member. The male members 154A are inserted in the female member 152 at spaced apart intervals throughout the length of the female member to lock the gap closing device on the adjacent sidewall panels. This saves material costs and facilitates the installation process. Further, this gap closing device may be installed on new cars during the installation of the sidewall panels or on existing cars.

It will be understood that modifications and variations may be effected without departing from the scope of the novel concepts of the present invention, and it is understood that this application is to be limited only by the scope of the appended claims.

The invention is hereby claimed as follows:

1. In an auto rack railroad car having opposed walls including a plurality of horizontally extending and vertically spaced apart sidewall panels defining horizontally extending gaps between adjacent upper and lower sidewall panels, each said sidewall panel having an outer face and an inwardly extending flange on the periphery thereof; the improvement being in means for closing the gaps between said adjacent upper and lower sidewall panels, said means comprising:

body means for positioning in each said gap and extending substantially the entire length of said gap, first arm means extending from the body means for mounting said body means to said lower sidewall panel and maintaining a substantially water-tight seal therewith, said first arm means including interior and exterior arms connected to said body means, second arm means extending from the body means for mounting said body means to said upper sidewall panel and maintaining a substantially water-tight seal therewith, said second arm means including interior and exterior arms connected to said body means, and means on said first and second arm means for locking said arm means onto the flanges of said sidewall panels, whereby air and water are prevented from entering said car through said gap.

2. The gap closing means as defined in claim 1, wherein said second arms means is longer than said first arm means to accommodate gaps of varying sizes.

3. The gap closing means as defined in claim 1, which includes means on said lower and upper exterior arms for grippingly and sealingly engaging said outer faces of said lower and upper sidewall panels.

4. The gap closing means as defined in claim 1, wherein said interior and exterior arms of said arm means mounted on said upper panel are spread apart and thereafter moved toward each other and locked in place on said upper panel.

5. The gap closing means as defined in claim 1, wherein said body means includes spaced apart interior and exterior walls which are connected by spaced apart top and bottom walls which provide structural rigidity to said gap closing means.

6. The gap closing means as defined in claim 5, wherein said interior and exterior upper and lower arms are integrally connected to said interior and exterior walls of said body means.

7. The gap closing means as defined in claim 5, wherein said body means is substantially box-shaped.

8. The gap closing means as defined in claim 1, wherein said body means includes a socket formed by spaced apart top and bottom walls interconnected by an exterior wall and a detached locking member formed by spaced apart top and bottom locking bars interconnected by an interior wall and adapted to be inserted into said socket.

9. The gap closing means as defined in claim 1, which further includes means connected to an exterior part of said gap closing means for directing and channeling water laterally of said panels.

10. The gap closing means as defined in claim 1, which further includes bumper means connected to an interior part of said gap closing means for preventing a vehicle door from contacting the sidewall of the auto rack railroad car.

11. The gap closing means as defined in claim 1, wherein said locking means includes a locking shoulder adapted to engage said flange.

12. In an auto rack railroad car having opposed walls including a plurality of horizontally extending and vertically spaced apart sidewall panels defining horizontally extending gaps between said adjacent sidewall panels, and each said sidewall panel having inwardly extending flanges on the peripheries thereof, the improvement being in a member for closing the gaps between said adjacent sidewall panels, said member comprising:

body means for positioning in and extending substantially the entire length of said gap and having attached interior and exterior walls, interior and exterior lower arms extending downwardly from the body means for mounting the member to said lower sidewall panel, and interior and exterior upper arms extending upwardly from the body means for mounting said body to said upper sidewall panel, said upper arms being longer than said lower arms to accommodate gaps of varying sizes, whereby said member prevents air and water from entering said car through said gap.

13. The gap closing member as defined in claim 12, which includes locking means on said interior arms for locking said arms onto the flanges of said upper and lower sidewall panels.

14. The gap closing member as defined in claim 13, which includes gripping means on said exterior arms for enhancing the sealing engagement between said exterior arms and said upper and lower sidewall panels.

15. The gap closing member as defined in claim 12, which further includes a rain diverter means connected to one of the exterior walls or arms of the member for channeling water laterally of the panels.

16. The gap closing member as defined in claim 12, which further includes bumper means connected to one of the interior walls or arms of the member for preventing a vehicle door from contacting the sidewall of the auto rack railroad car.

17. A gap closing-device closing an air gap between horizontally extending and vertically adjacent upper and lower screens of an auto rack railroad car, said screens having an outer face and an inwardly extending flange on the periphery thereof, said gap closing device comprising:

body means disposed in and extending substantially the entire length of said gap, interior and exterior upper arm means extending downwardly from said body means for mounting said body means on said lower sidewall panel, interior and exterior upper arm means extending upwardly from said body means for mounting said body means on said upper sidewall panel and for creating a substantially water-tight seal against the outer surface of said upper sidewall panel, whereby air and water are prevented from entering said car through said gap.

18. The device of claim 17, wherein said upper arm means includes diverging arms movable together and lockable during mounting on said upper panel.

19. The device of claim 17, wherein said body means is box-shaped.

20. The device of claim 19, wherein the box-shaped body means is formed from coacting and mating C-shaped members.

21. The device of claim 17, wherein the upper arm means are longer than said lower arm means to accommodate gaps of varying sizes.

22. A gap closing device closing an air gap between horizontally extending and vertically adjacent upper and lower sidewall panels of an auto rack railroad car, said panels having an outer face and an inwardly extending flange on the periphery thereof, said gap closing device comprising:

female means for engaging said adjacent upper and lower sidewall panels, and male means for locking said female means on said panels, said female means having a body, interior and exterior lower arm means extending from said body for mounting said female means on said lower sidewall panel, interior and exterior upper arm means extending from said body for slideably mounting said female means on said upper sidewall panel and for forming a substantially water-tight seal between said female member and said upper sidewall panel, and said body formed to receive said male means, and said male means having interconnected locking bar means for inserting into said body of said female means to lock said female member on said upper and lower sidewall panels, whereby said device prevents air and water from entering said car through said air gap and wherein said device may be installed on new or existing cars.

23. The device of claim 22, wherein said female and male means include coacting locking means which prevent the male means from being dislodged from the female means.

24. In an auto rack railroad car having opposed walls including a plurality of horizontally extending and vertically spaced apart sidewall panels defining horizontally extending air gaps between adjacent upper and lower sidewall panels, each said sidewall panel having an outer face and in inwardly extending flange on the periphery thereof, the improvement being in means for closing the air gap between adjacent sidewall panels, said means comprising:

an elongated plastic device closing and extending substantially the entire length of the air gap, said device being H-shaped and including a substantially box-shaped section disposed in the air gap, inner and outer upwardly extending means grippingly engaging the upper panel, and inner and outer downwardly extending means grippingly engaging the lower panel.

25. The device of claim 24, wherein the box-shaped section and said upwardly and downwardly extending means are a one-piece unit.

26. The device of claim 24, wherein the box-shaped section and said upwardly and downwardly extending means are a two-piece unit.

* * * * *

UNITED STATES PATENT AND TRADEMARK OFFICE

CERTIFICATE OF CORRECTION

PATENT NO. : 5,701,825

DATED : December 30, 1997

INVENTOR(S) : Walter J. Peach, Jr.

It is certified that error appears in the above-indentified patent and that said Letters Patent is hereby corrected as shown below:

On the title page item,
[56] References Cited:
change "4,945,727" to --4,946,727--
change "4,947,900 8/1990" to --4,974,900 12/1990--

Col. 11, line 9, change the semi-colon (;) to a comma (,)

Col. 12, line 45, change "upper" to --lower--

Signed and Sealed this

Thirty-first Day of March, 1998

Bruce Lehman

*Attest:*

BRUCE LEHMAN

*Attesting Officer*

*Commissioner of Patents and Trademarks*